US006073396A

United States Patent [19]

Kietzmann

[11] Patent Number: 6,073,396

[45] Date of Patent: Jun. 13, 2000

[54] GATE HINGE

[76] Inventor: Rudolph Kietzmann, 28667 390th Ave., Armour, S. Dak. 57313-6721

[21] Appl. No.: 08/883,568

[22] Filed: Jun. 26, 1997

Related U.S. Application Data

[63] Continuation-in-part of application No. 08/622,989, Mar. 28, 1996, abandoned.

[51] Int. Cl.[7] ..... E05D 15/00

[52] U.S. Cl. ..... 49/381; 49/239; 49/236; 16/237; 16/86.2

[58] Field of Search ..... 49/381, 236, 396, 49/239; 16/235, 236, 237, 238, 86.1, 86.2

[56] References Cited

U.S. PATENT DOCUMENTS

| | | | |
|---|---|---|---|
| 250,916 | 12/1881 | Henderson | 16/235 |
| 295,569 | 3/1884 | Lockling | 49/381 |
| 862,246 | 8/1907 | Gutelius | 49/381 |
| 1,066,792 | 7/1913 | Bruner | 49/381 |
| 1,537,420 | 5/1925 | Doddridge | 16/236 |
| 2,010,468 | 8/1935 | Spencer | 49/236 |
| 2,659,168 | 11/1953 | Kaplan | 49/381 |
| 2,685,142 | 8/1954 | Reinebach | 49/236 |
| 2,795,063 | 6/1957 | Butler | 49/381 |
| 2,810,220 | 10/1957 | Koch | 49/236 |
| 4,124,954 | 11/1978 | Redick | 49/381 |
| 4,141,109 | 2/1979 | Farrell | 16/237 |

FOREIGN PATENT DOCUMENTS

| | | | |
|---|---|---|---|
| 2645297 | 7/1976 | Germany | 49/351 |

*Primary Examiner*—Daniel P. Stodola
*Assistant Examiner*—Curtis A. Cohen

[57] ABSTRACT

A gate hinge is provided which enables a gate to be maintained upright and level in a first closed position and to clear obstacles or follow the contour of the ground when swung into a second position. The gate hinge hereof can be used in combination with a support post, a gate and a conventional hinge. The gate hinge includes a hinge pin preferably mounted on a threaded rod and a bearing attached to a second rod. One of the rods is attached to the support post, the other rod is attached by mounting brackets to the gate. The pivot axis of the hinge is offset relative to the pivot axis of the other hinge, so that during swinging of the gate, its angle of inclination relative to the support post changes.

15 Claims, 3 Drawing Sheets

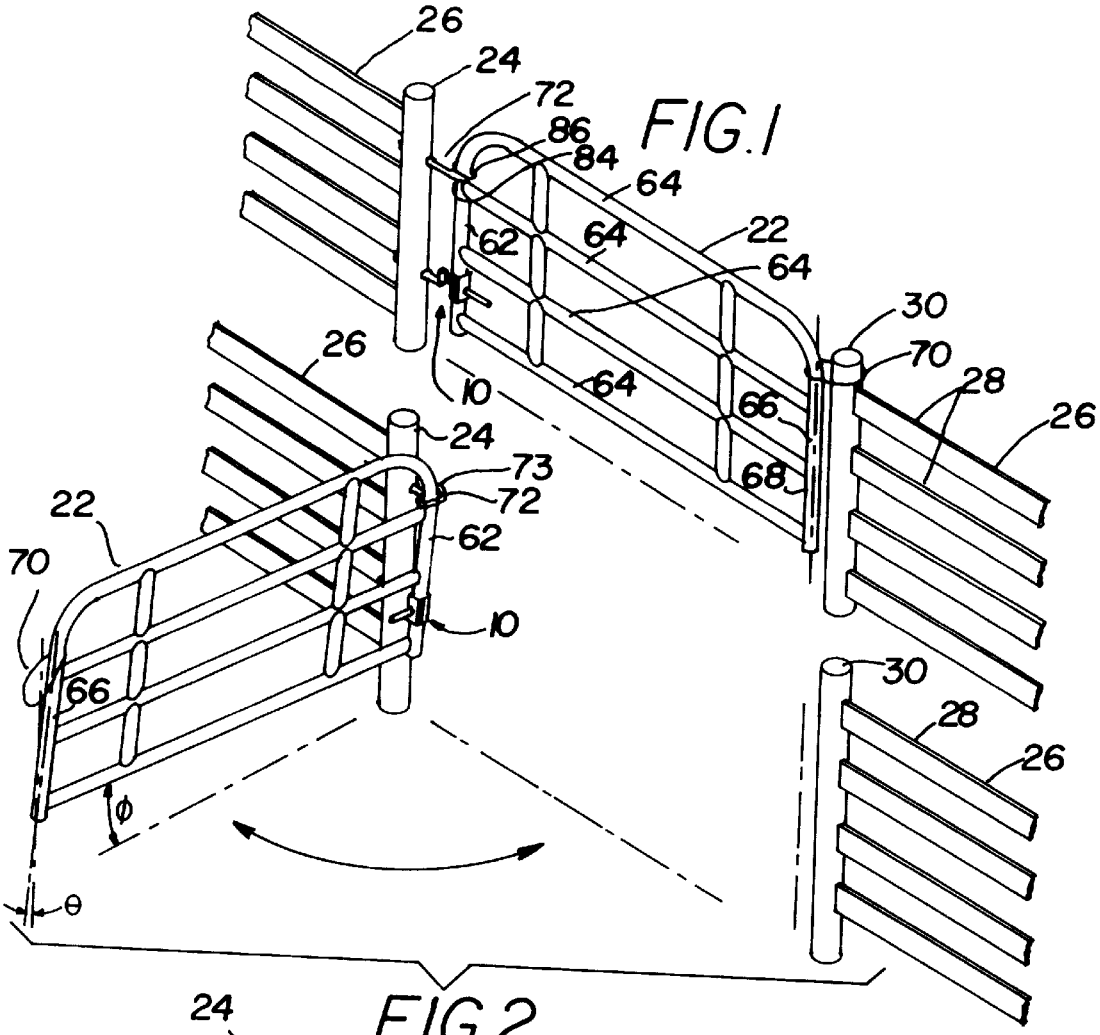
FIG.1
FIG.2
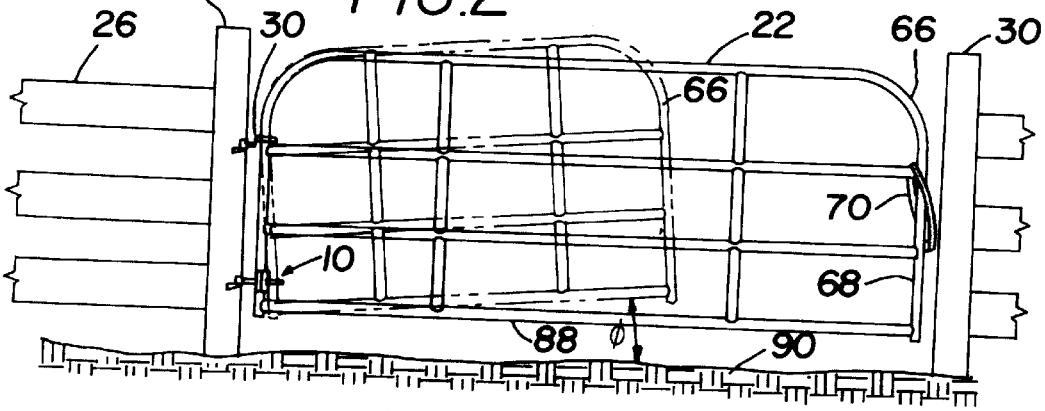
FIG.3

GATE HINGE

CROSS REFERENCE TO RELATED APPLICATION

This application is a continuation-in-part of my prior utility patent application Ser. No. 08/622,989, filed Mar. 28, 1996.

BACKGROUND OF THE INVENTION

1. Field of the Invention

This invention broadly concerns a hinge for use with a gate or other swinging structure and enabling the adjustment of the orientation of the gate in at least two different gate positions. More particularly, the gate hinge hereof enables the gate to remain level in a closed position but to raise or lower the remote end of the gate during swinging, and permits leveling the orientation of the gate despite the gate being mounted to a support post that is out of plumb.

2. Description of the Prior Art

Gates, and in particular gates used with fencing to provide access to a field or enclosure are well-known, it being typically desired to have the gate level to preserve the swinging function of the gate (e.g., avoid dragging the gate on the ground) and to present a pleasing appearance. Upper and lower hinges are used to support the gate while it swings between a closed position in general alignment with the fence and an open position to permit access through the gate.

One type of gate in common use in agriculture employs both upright and lateral tubes of a conventional size which receive conventional collars for coupling to the upright. The collars include a larger opening to receive the gate tube, and a smaller opening to receive a hinge pin integrally formed with and oriented normally to a threaded rod. The rod is connected to an upright fence post, with the gate pivoting on the hinge pin. With the gate level to the adjacent fence rails in a closed position, the latch at the remote end of the gate can be reliably fastened and livestock prevented from escaping through gaps between the gate and The fence post. Thus, for a variety of reasons, having the gate both level and substantially upright (in the closed position) is desirable.

Circumstances may well arise where it is also desirable to have the capability of changing the elevation of the remote end of the gate when it swings. When a fence is placed at an angle to a grade or slope, engagement of the gate with the ground may prevent proper or complete opening. Stumps, rocks or other obstacles may stand in the way of the gate as it swings. The installer may be faced with a choice of having a level gate perpendicular to the ground when closed or a gate which raises when it swings to open. In other circumstances it may be desired to have the gate lower as it opens so as to follow the ground in order to prevent small animals from escaping under the lowermost rail.

Another problem confronting gate users is presented when the posts of old fences eventually list, becoming out of plumb. This presents a problem of either replacing or repositioning a post, or leaving the gate in an unsightly angled position.

There is thus a need for a gate hinge which will permit adjustment of the orientation of the gate not only when the gate is in a closed position, but also will permit independent adjustment of the orientation of the gate when the gate is in another (e.g., open) position, especially in a manner such that the adjustment of the gate in one position does not alter the adjustment of the gate when in the other position.

There is also a need for a gate hinge which will enable a gate to be adjusted to a level orientation when the gate is in a closed position, and be adjusted in an open position to a level orientation or to an orientation in which the gate is substantially parallel to the ground surface.

There is further a need for a gate hinge which can be adjusted to conform to changes in, for example, the leaning of the post supporting the gate or the terrain of the ground surrounding the gate.

There is also a need for a gate hinge which can be retrofitted for use on existing fence posts and gates to reorient the gate when the fence post has moved out of a plumb orientation.

SUMMARY OF THE INVENTION

These and other objects are largely met by the gate hinge of the present invention. The gate hinge hereof uses a minimum of components, provides great flexibility in operation and is simple to install. Moreover, the gate hinge hereof permits a self-closing function without springs which wear out or the addition of weights, chains and additional posts which add expense and may present obstacles during use or to animals within the enclosure.

Broadly speaking, the gate hinge hereof includes any hinge structure which permits the gate to remain level and upright in a closed position and to offset the pivot axes between upper and lower hinges. With particular reference to the preferred embodiment, a gate hinge hereof includes a pivot member including a pivot pin defining a pivot axis, a receiving member presenting a bearing for pivotally connecting to the pivot member, and a mounting member for attaching one of the pivot member and receiving member to the gate. The receiving member includes a bearing complementarily configured to receive a hinge pin on the pivot member. The receiving member and pivot member are preferably provided with threaded arms to enable the pivot axis to be laterally positioned as desired during installation. The gate hinge hereof may be used with another gate hinge in accordance with the present invention or a conventional collar whereby the pivot axes of the upper and lower hinges may be offset or coincident.

The hinge structure of the present invention permits the axis of the hinge to not only be moved closer to the support post on which the hinge is mounted, but also permits the axis of the hinge to be moved closer to the leg of the gate support by the hinge. This unique relationship permits the adjustment of the gate into a level orientation at two gate positions, with the adjustment of the gate orientation at one position not affecting the ability to adjust the orientation of the gate at another position.

These and other advantages may be readily appreciated by those skilled in the art with reference to the drawing and the following description of the preferred embodiment.

BRIEF DESCRIPTION OF THE DRAWINGS

FIG. 1 is a perspective view showing the gate hinge hereof and a conventional hinge pivotally supporting a gate mounted between two posts and positioned in a closed position;

FIG. 2 is a view similar to FIG. 1, showing the gate pivoted into an open position with the remote end raised;

FIG. 3 is an elevational view of the gate hinge hereof and a conventional hinge pivotally supporting a gate, with the gate level respective to the adjacent fence in a closed position, with the gate swung open shown in phantom;

DESCRIPTION OF THE PREFERRED EMBODIMENT

Figure 4:
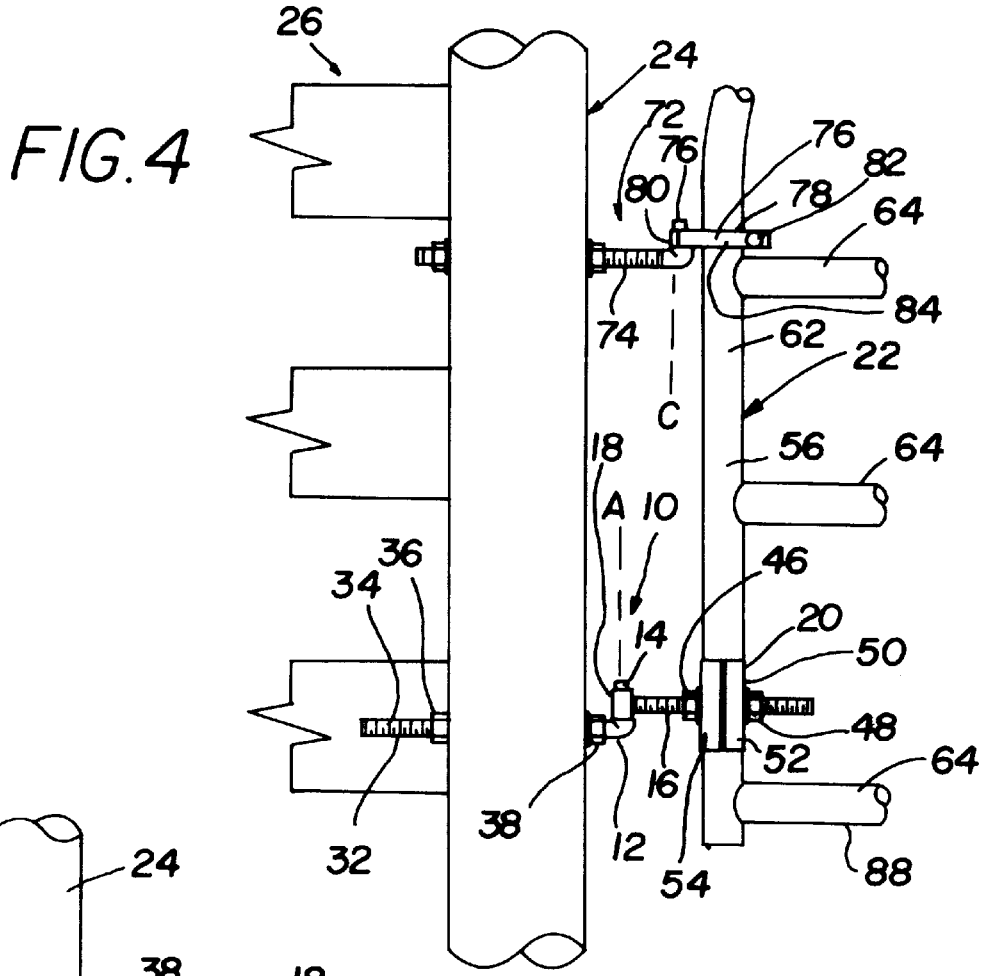
FIG. 4 is an enlarged, fragmentary elevational view of the gate hinge shown in FIG. 3, showing the offset pivot axes of the gate hinge hereof in the lower position and a conventional hinge in the upper position on the gate.

A gate hinge 10 in accordance with the present invention broadly includes a pivot member 12 presenting a hinge pin 14 defining a pivot axis A thereof, a receiving member 16 having a bearing 18 complementarily configured to the hinge pin 14. Mounting member 20 is preferably provided to mount one of the first or second members to a gate 22. The gate hinge 10 is typically coupled to both the gate 22 and a support post 24. The support post 24 is typically part of a fence 26 having a plurality of generally horizontally extending rails 28, with the gate positioned between the support post 24 and a fence endpost 30. The gale hinge 10 may be used in combination with another similar gate hinge 10, or with a conventional hinge 72 as shown in FIGS. 1–4. The elongated shaft member and the mounting element of the first and second hinge assemblies are preferably adapted to be removably connected together (as shown in FIG. 5) to form the first and second pivots, respectively.

Figure 5:
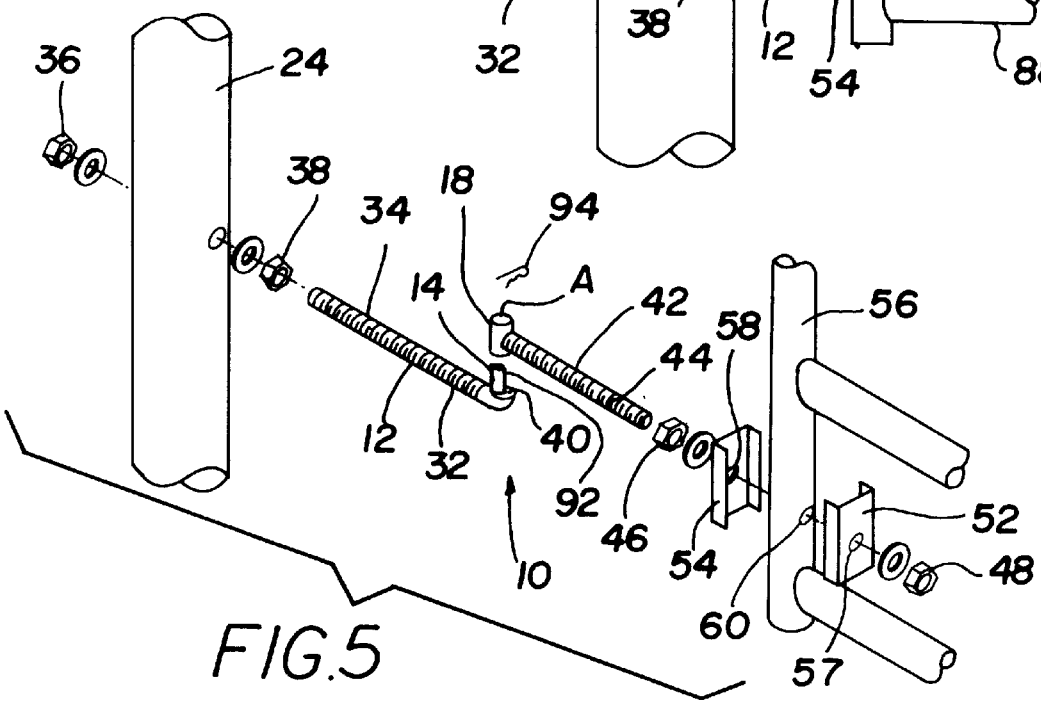
FIG. 5 is an exploded perspective view of the gate hinge hereof.

In greater detail as shown in FIG. 5, the pivot member 12 includes an elongated rod member 32 having external threads 34 thereon for receiving nuts 36 and 38, with suitably sized washers provided between the nuts 36 and 38 and the support post 24. The hinge pin 14 is oriented at a 90° angle from the longitudinal axis of the elongated rod member 32, and a shoulder 40 of a greater cross sectional area than that of the hinge pin 14 is provided adjacent the base of the hinge pin 14 for supporting the bearing 18 on the receiving member 16. The bearing 18 is in the form of a cylinder having an inside diameter slightly greater than the outside diameter of the hinge pin 14. This difference allows a slight rocking action between the bearing 18 and the hinge pin 14 to permit the gate to raise (or lower) as it swings. The bearing 18 is located at an end of a elongated rod member 42 having external threads 44 thereon for receiving nuts 46 and 48 thereon. Again, the bearing is oriented so that its pivot axis A shared with the hinge pin 14 is oriented at a 90° angle to the longitudinal axis of the elongated rod 42. Ideally, the length of the threaded portion of the elongated rod member 32 is at least about 12 inches, and the length of the threaded portion of the elongated rod member 42 is at least about 6 inches.

The mounting member 20 for connecting either the pivot member 12 or the receiving member 16 to the gate 22 preferably includes a clamp 50 and the internally threaded nuts 36 and 38 or 46 and 48. The clamp 50 includes U-shaped brackets 52 and 54 each presenting a respective hole 57 and 58 therethrough for receiving one of the elongated rods 32 and 42 depending on whether the receiving member or pivot member is attached to the gate 22. The brackets 52 and 54 are designed for use with a gate 22 having a generally upright leg 56, and permit the nuts to engage with a flat surface for securely fastening the gate hinge 10 to the gate 22. The upright leg 56 is preferably provided with a bore 60 for receiving one of the elongated rods therethrough. The gate 22 presents a proximate end 62 including the upright gate leg 56 to which the gate hinge 10 hereof is interconnected, a plurality of normally substantially horizontal bars 64, and a remote end 66 which includes a normally upright stanchion 68 typically carrying a latch or loop 70 for holding the remote end 66 closed adjacent the endpost 30.

The gate hinge 10 hereof may be used in combination with a conventional hinge 72 well known in the art. Such a conventional hinge 72 includes a pivot arm or shaft member 74 similar to the pivot member 12 described above and including a pivot pin 76. The conventional hinge 72 also includes a collar 76 configured as an open-bottom FIG. 8 presenting a larger opening 78 for fitting around the upright leg 56 and a smaller opening 80 for receiving the pivot pin 76. The larger opening 78 is clamped around the upright leg 56 in a well known manner by tightening a crossbolt 82 extending between fingers 84 and 86 defining the opening 78. The smaller opening 80 and pivot pin 76 thus define a fixed first pivot axis C which cannot be varied in distance from the upright leg 56.

When a user desires to maintain a gate level in the closed position as shown in FIGS. 1, 3 and 4, but have the remote end 66 rise as shown in FIG. 2 and in phantom in FIG. 3, the gate hinge 10 hereof is preferably installed at the lower position on the gate 22 when a conventional hinge 72 is also used. Either the pivot member 12 or the receiving member 16 may be connected to the gate 22 by installing the elongated rod member through the bore 60, placing the brackets 52 and 54 of the clamp 50 around the upright leg 56, and installing the washers and nuts thereon as shown in FIG. 5. In the drawing, the receiving member 14 is shown installed on the upright leg 56 of the gate 22, with the pivot member 12 installed through a similar hole in the support post. In order to have the remote end 66 of the gate 22 rise when it swings open, the second pivot axis A of the gate hinge 10 is offset relative to the first hinge pivot axis C of the conventional hinge 72 so that the second axis A is closer to the support post 24, as shown in FIG. 4. Because the first pivot axis C is fixed relative to the upright gate leg 56, the gate hinge 10 hereof permits the user to select the amount of offset corresponding to the desired angle of inclination (phi) when the gate 22 swings open. The offset as used herein refers to the difference of the distance from the upright leg 56 of the gate 22 for the axes A and C. For example, the offset between axes A and C as shown in FIG. 4 represents the maximum offset as the axis C is fixed and the axis A is at about its farthest possible location from the upright leg 56. This may be expressed as a positive offset. If it is desired to lessen the angle (phi) and thus the amount the remote end rises, the nuts 36 and 38 and also 46 and 48 can be loosened and the elongated rods members shifted longitudinally to position the hinge pin 14 and the bearing 18 closer to the gate 22. This will maintain the gate 22 level in a closed position shown in FIGS. 1 and 4, and will adjust the amount of the rise of the remote end during swinging. If the offset between the axes A and C is zero, then there will be no rise, the gate will swing levelly (provided the support post 24 is plumb), and the angle (phi) will be zero. As the distance between the hinge 72 and the gate hinge 10 hereof decreases, the effect of the offset increases, and thus the effect of the offset will decrease as the distance between the hinge 72 and the gate hinge 10 increases.

As the remote end 56 of the gate 22 rises when the gate swings open, the remote end also twists to an angle (theta) as shown in FIG. 2, caused by the offset geometry of the axes A and C. To permit the gate 22 to rise and twist even though the second pivot axis A defined by the hinge pin 14 is fixed, it is necessary that the bearing 18 have a somewhat greater inner diameter than the outer diameter of the hinge pin 14. The limited rocking movement as the remove end lifts and twists as shown and described herein is thereby permitted, while maintaining the gate 22 level in the closed position as shown in FIGS. 1, 3 and 4.

It may be desirable to have the remote end 66 of the gate lower as it swings, for example when the gate 22 is used as a cutting gate to move small animals such as pigs, sheep or calves in a livestock pen and the ground slope decreases in the direction the gate must swing. In those circumstances, it is desirous to maintain the bottom 88 of the gate as close to the ground 90 as possible, thereby inhibiting animals from escaping under the gate 22. It is thus desirable to achieve a negative offset. One way of accomplishing this is to shift the second pivot axis A of the gate hinge 10 closer to the gate 22 than the first pivot axis C of the conventional hinge 72 when the gate hinge 10 hereof is used as the lower hinge. This may be readily accomplished when the gate hinge 10 hereof is used in both the upper and lower hinge positions, but may be difficult when a conventional hinge 72 is used in the upper position, as there is very little room between the first pivot axis C and the upright leg 56. Another alternative is to use the gate hinge 10 hereof in the upper hinge position, thus effectively reversing the gate hinge 10 and the conventional hinge 72 from their positions shown in FIG. 4. With the gate hinge 10 above the conventional hinge, the offset relationship is reversed, so that the further away from the upright leg 56 the second pivot axis A is relative to the first pivot axis C, the more the remote end of the gate lowers as it swings open. The gate 22 is not self-closing in this manner of use, but can be advantageously employed in certain situations.

A significant feature of the gate hinge of the invention is the ability to level the orientation of the gate in more than one positioning of the gate. As described above, the orientation of the gate may be adjusted when the gate is in a closed position by adjusting the longitudinal position of the elongate rod member 32 within the aperture through the support post 24, such that the distance between the second pivot axis A and the support post is varied until a crossbar 64 of the gate is brought into a substantially level orientation. Once the gate has been leveled in the first (e.g., closed) position, the gate may be swung into a second position and the second hinge assembly 10 adjusted so that the gate is brought into a level orientation in the second position. Illustratively, the gate may be swung from the closed position approximately 90 degrees into a second (e.g., open) position. At the second position, the crossbar 64 of the gate may be brought into a substantially level orientation by adjusting the longitudinal position of the elongate rod member 42 within the aperture in the upright gate leg 56 such that the distance between the second pivot axis A and the gate leg is varied until a crossbar 64 of the gate is brought into a substantially level orientation. The ability to adjust the orientation at a second position of the gate is advantageous for leveling the gate so that the remote end of the gate does not drop as the gate swings and drag the remote end across the ground surface. Optionally, the second hinge assembly 10 may be adjusted so that at the second position the gate has a specific desired orientation different from a level orientation.

Figure 6:
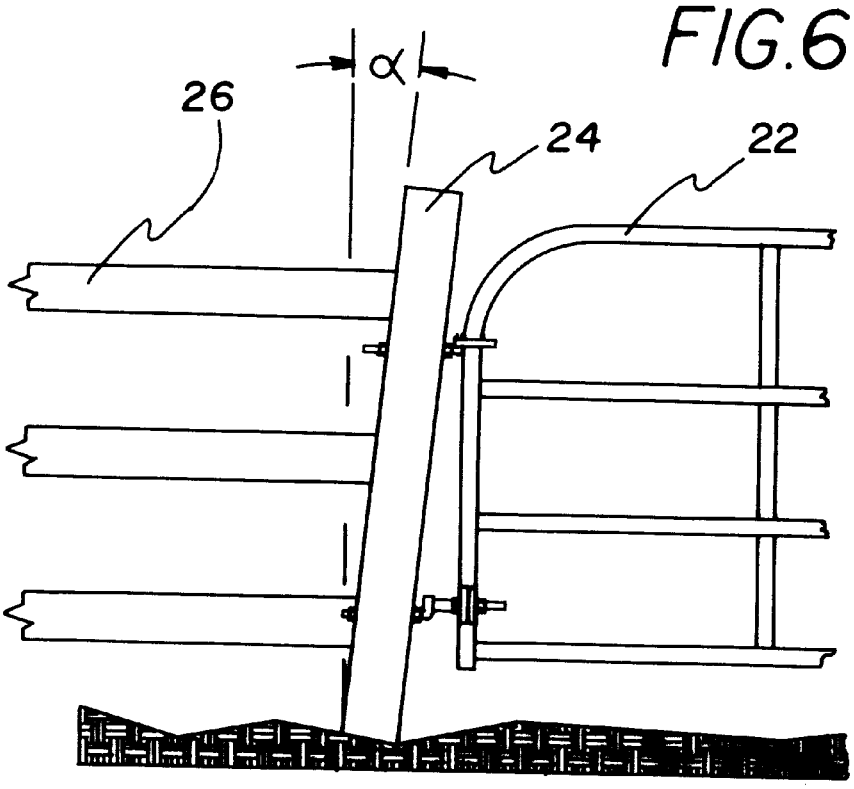
FIG. 6 is a fragmentary elevational view of the gate hinge mounted on a support post sloping in a plane of the gate in the closed position.
Figure 7:
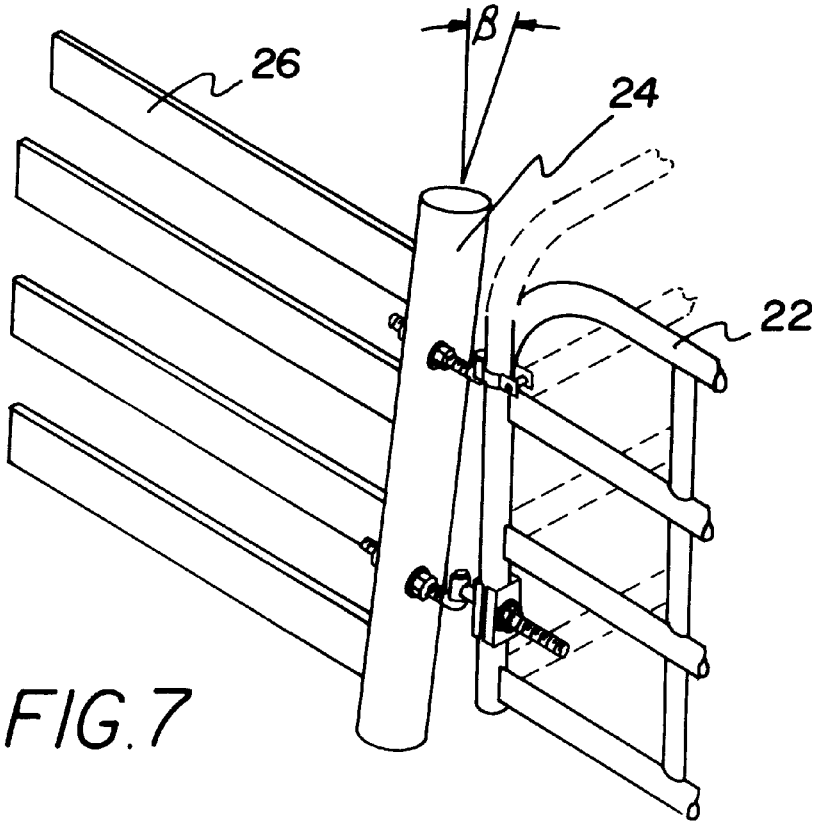
FIG. 7 is a fragmentary perspective view of the gate hinge mounted on a support post sloping in a plane orthogonal to the plane of the gate in a closed position.

Another significant advantage of the gate hinge described herein is its capability for use in retrofitting existing fence and gate assemblies, especially in applications where the support post 24 has become bent from the weight of the gate, or for some other reason the post 24 is no longer in a plumb orientation. The gate hinge may be installed on an existing support post and gate without having to reset or replace the leaning support post in order to obtain a plumb support for the gate. The dual adjustment of the rod members 32, 42 permits compensating for any leaning of the post 24 while bringing the gate into a level orientation. The ability to compensate for leaning post applies whether the post leans in a direction substantially parallel to the plane of the closed gate (e.g., at an angle alpha $\alpha$ in FIG. 6), or if the post leans in direction substantially perpendicular to the plane of the closed gate (e.g., at an angle beta $\beta$ in FIG. 7), or if the post leans in a some combination of the parallel and perpendicular directions.

Further, when the support post 24 of a gate having the gate hinge of the invention installed thereon begins to lean after years of use and exposure to the environment, the first hinge assembly 72 and the second hinge assembly 10 may be adjusted to compensate for the lean of the support post without having to reset the post or having to remove the gate from the hinge or post. By simply increasing or decreasing the distance the rods 32 and 42 extend between the support post 24 and the upright leg 56, the gate 22 may again be returned to a level position. In certain circumstances, such as when wooden support posts 24 and gates 22 are used, it may be desired to have screw-type threading rather than use nuts on constant-size threading as shown in the drawing. In that circumstance, the installation and use is the same as described herein, except that instead of installing nuts to secure the elongated rods in position, the rods are threaded into the wood or other media in a conventional manner, then rotated to adjust the offset. Furthermore, in the embodiment shown in the drawing, the gate 22 may be releveled at a later date or the amount of rise (or lowering) during swinging adjusted because the position of the axis A may be changed by loosening the nuts and repositioning the elongated rods 32 and 42.

The gate hinge 10 hereof also preferably includes a transverse hole 92 at the top of the hinge pin 14 for receiving a cotter pin 94 therethrough. Thus, the bearing 14 is able to rest on the shoulder of the pivot member 12 and remains around the hinge pin 14 during swinging of the gate 22.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. A kit for pivotally mounting a gate to a support post, said gate, with which the kit is to be used, having a gate leg with at least one aperture there through and at least one cross bar oriented substantially orthogonal to said support post with which the gate leg is to be used, and said kit having two generally vertically spaced apertures extending therethrough, said kit comprising:

a first hinge assembly comprising an elongated shaft member and a mounting element pivotally, connected together to form a first pivot, said first pivot comprising a hinge pin mounted on the elongated shaft member of said first hinge assembly and a bushing for receiving said hinge pin mounted on the mounting element of said first hinge assembly, said hinge pin defining a first axis, said shaft member having external threads along the length thereof, said first hinge assembly including a pair of internally threaded nuts mountable on the threaded portion of said shaft member at adjustable positions along the length thereof for securing said shaft member in the aperture of said support post in a longitudinally adjustable manner by abutting a nut on said shaft member against the exterior of said support post at each end of said aperture, and a second hinge assembly comprising a pair of elongated rod members pivotally connected together to form a second pivot, said second pivot comprising a hinge pin mounted on one of said rod members and a bushing for receiving said hinge pin mounted on the other of said rod members, said hinge pin defining a second axis, each of said rod members having external threads along a portion of the length thereof, said pair of elongated rod members comprising a first rod member and a second rod member, said second hinge assembly including a pair of internally threaded nuts for mounting on the threaded portion of said first rod member at adjustable positions along the length thereof for securing said first rod member in an aperture of said support post in a longitudinally adjustable manner by abutting a nut on said first rod member against the exterior of said support post at each end of the aperture through said support post, said second hinge assembly including a second pair of internally threaded nuts for counting on the threaded portion of said second rod member at adjustable positions along the length thereof such that said second rod member is adjustably longitudinally securable in an aperture of said gate leg by abutting a nut on said second rod member against the exterior of said gate leg at each end of said aperture, whereby the distance between the second axis and the gate leg and the distance between the second axis and the support post are both adjustable to place the gate in a level orientation at multiple locations along the swing of the gate; said first and second axes are parallel to each other; and wherein the distance between the second axis of the second hinge assembly and the gate post may be adjusted independent of the distance between the first axis of the first hinge assembly and the gate post such that the distance between the gate leg and one of said first and second axes can be adjusted without changing the distance between the gate leg and the other of said first and second axes.

2. The kit of claim 1 additionally comprising a pair of clamping brackets adapted for mounting in opposed relationship with the gate leg received therebetween, each of said brackets having a hole therethrough for receiving said second rod member such that said clamping brackets resist any crushing of the leg by tight abutment of a nut threaded onto said second rod member against each clamping bracket; and wherein said mounting element of said first hinge assembly comprises a C-shaped clamp for clamping on the gate leg such that the bushing is held at a fixed distance from said gate leg;

wherein the threaded portion of one of said rod members of said second hinge assembly is at least 12 inches in length;

wherein the threaded portion of the other of said rod members of said second hinge assembly is at least 6 inches in length; and wherein said mounting element is adapted to mount said first pivot to said gate leg in a manner such that the distance between said first axis and said gate leg is substantially fixed.

3. The kit of claim 1 wherein the threaded portion of at least one rod member of said second hinge assembly is at least 12 inches in length.

4. The kit of claim 1 additionally comprising a pair of clamping brackets adapted for mounting in opposed relationship with the gate leg received therebetween, each of said brackets having a hole therethrough for receiving said second rod member such that said clamping brackets resist any crushing of the leg by tight abutment of a nut threaded onto said second rod member against each clamping bracket.

5. The kit of claim 1 wherein said mounting element is adapted to mount said first pivot to said gate leg in a manner such that the distance between said first axis and said gate leg is substantially fixed.

6. In combination a gate having a proximate end including a gate leg with an aperture therethrough, at least one crossbar oriented transverse to said gate leg, and a remote end;

a support post proximate to said gate leg, said support post having two spaced apertures therethrough, said apertures comprising an upper and a lower aperture;

a first hinge assembly pivotally connecting said gate and said support post, said first hinge assembly including an elongated shaft member and a mounting element pivotally connected together at a first pivot, said shaft member having external threads along a portion of the length thereof, said first hinge assembly including a pair of internally threaded nuts, said shaft member extending through the upper aperture of said support post and having a nut threadedly mounted on the threaded portion of said shaft member in abutment against an exterior of said support post at each end of the upper aperture therein to permit longitudinal adjustment of said shaft member in the upper aperture to thereby permit adjustment of the distance between the first pivot and said gate leg; and a second hinge assembly pivotally connecting said gate and said support post, said second hinge assembly including a pair of elongated rod members pivotally connected together at a second pivot, each of said rod members having external threads along a portion of the length thereof, said pair of elongated rod members comprising a first rod member and a second rod member;

said second hinge assembly including a pair of internally threaded nuts, wherein said first rod member extends through the lower aperture of said support post and has a nut threadedly mounted on the threaded portion of said first rod member in abutment against an exterior of said support post at each end of the lower aperture therein to permit longitudinal adjustment of the position of said first rod member in the lower aperture to thereby permit adjustment of the distance between the second pivot and the support post;

said second hinge assembly including a second pair of internally threaded nuts, wherein said second rod member extends through the aperture of said gate leg and has a nut threadedly mounted on the threaded portion of said second rod member in abutment against an exterior of said gate leg at each end of the aperture therein to permit longitudinal adjustment of the position of said second rod member in said aperture to thereby permit adjustment of the distance between the second pivot and said gate leg;

whereby the distance between the second pivot and the gate leg and the distance between the second pivot and the support post are both adjustable to place the gate in a level orientation at multiple locations along the swing of the gate; said first and second axes are parallel to other; and wherein the second pivot of the second hinge assembly is positionable independent of the position of the first pivot of the first hinge assembly such that the respective distances between the gate leg and said first and second pivots can be varied with respect to each other.

7. The combination of claim 6 wherein the upper aperture through said support post has a length, and wherein the shaft member of said first hinge assembly has an externally threaded portion having a length at least one and a half times the length of the upper aperture to permit longitudinal adjustment of the shaft member in the upper aperture;

wherein the lower aperture through said support post has a length, and wherein the shaft member of said second hinge assembly lodged in the lower aperture has an externally threaded portion having a length at least one and a half times the length of the lower aperture to permit longitudinal adjustment of the shaft member in the lower aperture; and wherein the aperture through said gate leg has a length, and wherein the shaft member of said second hinge assembly lodged in the gate leg has an externally threaded portion having a length at least twice the length of the aperture in said gate leg to permit longitudinal adjustment of the shaft member in the aperture.

8. The combination of claim 6 wherein the threaded portion of at least one of said rod members of said second hinge assembly is at least 12 inches in length.

9. The combination of claim 6 additionally comprising a pair of clamping brackets in opposed relationship with said gate leg received therebetween, each of said brackets having a hole therethrough for receiving the second rod member of said second hinge assembly.

10. The combination of claim 6 wherein said support post is positioned in an orientation at a slope to the vertical.

11. The combination of claim 10 wherein the slope of said support post has a component parallel to the plane of the gate in a closed position.

12. The combination of claim 11 wherein the slope of said support post has a component orthogonal to the plane of the gate in a closed position.

13. The combination of claim 6 wherein said first pivot comprises a hinge pin mounted on said rod member of said first hinge assembly and a bushing mounted on said mounting element of said first hinge assembly, said bushing receiving said hinge pin; and wherein said second pivot comprises a hinge pin mounted on one rod member of said pair of rod members and a bushing mounted on the other rod member of said pair of rod members and receiving said hinge pin.

14. The combination of claim 13 wherein the hinge pin of said second hinge assembly is mounted on said first rod member.

15. The combination of claim 6 wherein said mounting element is mounted to said gate leg in a manner such that the distance between said gate leg and the first pivot is substantially fixed.

* * * * *